US010316534B2

(12) United States Patent
Michelon et al.

(10) Patent No.: US 10,316,534 B2
(45) Date of Patent: Jun. 11, 2019

(54) SWIMMING POOL CLEANING ROBOT AND METHOD FOR USING SAME

(71) Applicant: ZODIAC POOL CARE EUROPE, Bron (FR)

(72) Inventors: Thierry Michelon, Toulouse (FR); Philippe Pichon, Villeneuve de Riviere (FR); Jerome Bonnin, Toulouse (FR); Philippe Blanc Tailleur, Toulouse (FR); Hendrikus Johannes Van der Meijden, Midrand (ZA); Philip John Newman, Midrand (ZA)

(73) Assignee: ZODIAC POOL CARE EUROPE, Bron (FR)

( * ) Notice: Subject to any disclaimer, the term of this patent is extended or adjusted under 35 U.S.C. 154(b) by 0 days.

(21) Appl. No.: 16/073,269

(22) PCT Filed: Jan. 23, 2017

(86) PCT No.: PCT/FR2017/050133
§ 371 (c)(1),
(2) Date: Jul. 26, 2018

(87) PCT Pub. No.: WO2017/129884
PCT Pub. Date: Aug. 3, 2017

(65) Prior Publication Data

US 2019/0040642 A1 Feb. 7, 2019

(30) Foreign Application Priority Data

Jan. 29, 2016 (FR) ..... 16 50744

(51) Int. Cl.
*E04H 4/16* (2006.01)

(52) U.S. Cl.
CPC ..... *E04H 4/1654* (2013.01)

(58) Field of Classification Search
CPC ..... E04H 4/1654
(Continued)

(56) References Cited

U.S. PATENT DOCUMENTS 5,435,031 A * 7/1995 Minami ..... E04H 4/1654 15/1.7
2001/0032809 A1 10/2001 Henkin et al.
(Continued)

FOREIGN PATENT DOCUMENTS

FR 2929311 10/2009
FR 2925551 1/2010
(Continued)

OTHER PUBLICATIONS

International Patent Application No. PCT/FR2017/050133, "International Search Report (including English translation) and Written Opinion", dated Jun. 1, 2017, 12 pages.

*Primary Examiner* — Fred Prince
(74) *Attorney, Agent, or Firm* — Kilpatrick Townsend & Stockton LLP; Dean W. Russell

(57) ABSTRACT

The invention relates to swimming pool cleaning robot (10) comprising: a body (11); at least one hydraulic circuit through which a liquid flows between at least one liquid inlet (13) and at least one liquid outlet (14), said hydraulic circuit including at least one means for separating debris suspended in the liquid; pumping means for driving the liquid through the hydraulic circuit; means for driving and guiding the cleaning robot on a surface; and means for controlling the operating parameters of the means for driving and guiding the cleaning robot (10). The control means comprise a pressure sensor (21) that can be used to determine the immersion depth of the cleaning robot in a swimming pool, and means for automatically controlling the measured pressure on the basis of a set value.

25 Claims, 3 Drawing Sheets

Figure 1:
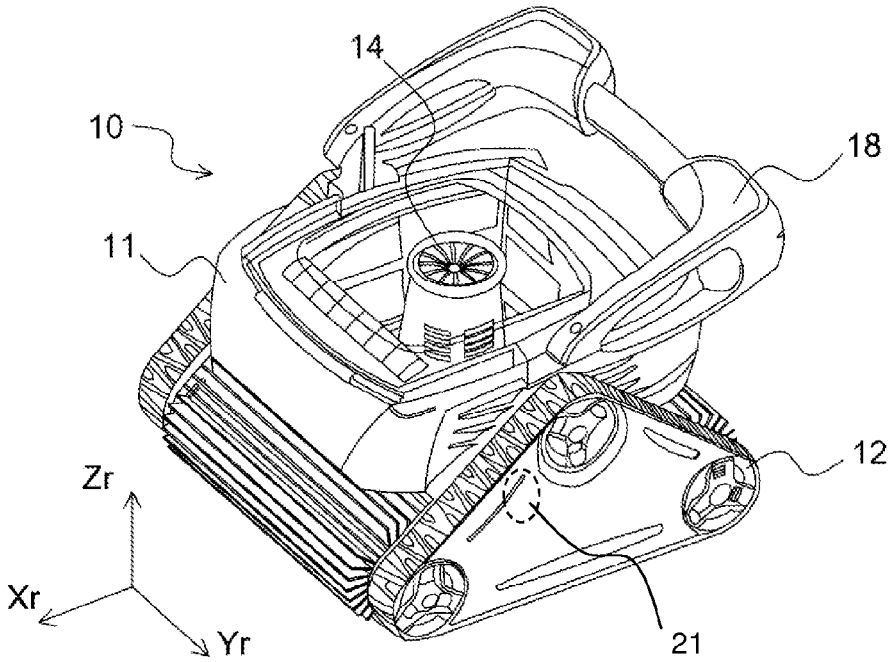

(58) Field of Classification Search
USPC ..... 210/167.1, 167.15, 167.16, 167.17, 232, 210/416.2
See application file for complete search history.

(56) References Cited

U.S. PATENT DOCUMENTS

| | | | | |
|---|---|---|---|---|
| 2003/0201218 | A1* | 10/2003 | Henkin | E04H 4/1654 210/167.16 |
| 2011/0020139 | A1* | 1/2011 | Pichon | E04H 4/1654 417/46 |
| 2011/0247970 | A1 | 10/2011 | Evingham | |
| 2015/0101135 | A1* | 4/2015 | Witelson | B66B 9/00 15/1.7 |
| 2017/0215261 | A1* | 7/2017 | Potucek | A61H 33/005 |
| 2018/0229160 | A1* | 8/2018 | Witelson | B01D 29/6415 |

FOREIGN PATENT DOCUMENTS

| | | |
|---|---|---|
| FR | 2925557 | 9/2013 |
| FR | 2954380 | 3/2015 |

* cited by examiner

SWIMMING POOL CLEANING ROBOT AND METHOD FOR USING SAME

CROSS-REFERENCE TO RELATED APPLICATIONS

This application is a national phase entry under 35 USC § 371 of International Application PCT/FR2017/050133 ("the '133 application"), filed Jan. 23, 2017, and entitled SWIMMING POOL CLEANING ROBOT AND METHOD FOR USING SAME, which claims priority to and benefit of French Patent Application No. 1650744 ("the '744 application"), filed on Jan. 29, 2016, and entitled SWIMMING POOL CLEANING ROBOT AND METHOD FOR USING SAME. The '133 application and the '744 application are hereby incorporated in their entireties by this reference.

This invention relates to the field of equipment for swimming pools. It most particularly relates to a swimming pool cleaning robot capable of moving along inclined walls.

PREAMBLE AND PRIOR ART

The invention relates to a cleaning apparatus for a surface immersed in a liquid, such as a surface formed by the walls of pool, particularly a swimming pool. In particular it relates to a mobile robot for cleaning a swimming pool. Such a cleaning robot performs said cleaning by travelling along the bottom and the walls of the swimming pool, brushing the walls, and drawing in the debris to a filter. Debris means all particles present at the bottom of the pool such as pieces of leaves, micro-algae; etc., this debris normally being deposited at the bottom of the pool or attached to the side walls of the pool.

Usually, the robot is supplied with energy through an electric cable connecting the robot to an external control and power supply unit.

For example, in this field, patents FR 2 925 557 and 2 925 551 deposited by the applicant are known, and relate to an immersed surface cleaning apparatus with a removable filter device. Such devices usually comprise a body, elements to drive said body on the immersed surface, a filtration chamber formed inside the body and comprising a liquid inlet, a liquid outlet, and a hydraulic circuit through which liquid circulates between the inlet and the outlet through a filter device. There is also patent FR 2 954 380 issued by the same applicant, that relates to a swimming pool cleaning robot provided with an accelerometer to determine attitude changes within the pool.

There is also patent application FR 2 929 311, by the applicant, that relates to a rolling immersed surface cleaning apparatus with a combined hydraulic and electric drive. The rolling apparatus climbs along the surface, particularly due to the presence of a pumping device supplying a hydraulic flux oriented to provide a vertical thrust to the rolling apparatus. A pressure sensor, used to know the immersion depth making use of a pressure measurement, is present in the rolling apparatus to detect the proximity of the water line to limit the rate of rise of the rolling apparatus close to the water line. This limitation to the rate of ascent prevents the apparatus from passing above the water line and drawing in air, and is achieved by reducing the power of the pumping device and consequently the vertical thrust of the water jet.

These apparatuses have automatic programs for cleaning the bottom of the pool and possibly the sides of the pool. Such a program determines cleaning of the pool over a given time period, for example an hour and a half.

Furthermore, the robot is usually held at the water line to clean this line making use of the equilibrium between the Archimedes' thrust and the weight of the robot when the robot is at the level of the water line. Cleaning apparatuses are balanced by the addition of a float or ballast so as to float at the water line, so that they can thus clean the water line by following it naturally.

The user generally takes the robot out of the water at the end of the cycle or at regular intervals so as to clean it when the filter contains too many particles (leaves, microparticles, etc.).

Furthermore, in prior art, depending on the nature of the surface of the pool, the cleaning robot may or may not correctly climb the surfaces of the pool to clean them. It is known that ballasts or floats can be added to modify its behaviour. It is clear that this installation was not convenient, it required additional means not available to the final user of the robot, and caused large variations in the behaviour of the robot in all of its movements.

Furthermore, the filter fills up with particles as the pool is being cleaned, generating an additional mass and possibly blocking the filter. Thus, a robot with a blocked filter may have difficulty in climbing along the walls and reaching the water line. Firstly, the mass of the robot is increased because the filter is becoming filled. Secondly, in the case of a robot comprising means of creating contact pressurisation or axial thrust related to pumping of water, clogging of the filter reduces the contact pressurisation force or the axial thrust of the robot towards the surface.

Therefore the invention aims to solve some of these problems. In particular, the invention relates to a swimming pool cleaning apparatus with improved behaviour on a vertical wall, and that can provide uniform cleaning of the swimming pool.

A main purpose of the invention is to disclose a technique for a swimming pool cleaning robot capable of reliably reaching the water line of a pool, particularly regardless of the circumstances, and more particularly regardless of the adhesion of the robot to the surface of the vertical wall of the pool and regardless of the extent to which the filter is clogged. At the present time, a cleaning robot is usually adjusted for a clean filter and average adhesion to the swimming pool wall.

Another main purpose of the invention is to disclose a technique for a swimming pool cleaning robot such that the swimming pool can be cleaned uniformly, and more particularly can be cleaned at a constant immersion depth.

PRESENTATION OF THE INVENTION

A first aspect of the invention relates to a swimming pool cleaning robot comprising:

- a body,
- at least one hydraulic liquid circulation circuit between at least one liquid inlet and at least one liquid outlet, said hydraulic circuit comprising at least one means of separating debris in suspension in the liquid,
- pumping means for maintaining the flow of liquid in said hydraulic circuit,
- means of driving and guiding said robot on a surface,
- means of controlling operating parameters of the means of driving and guiding said cleaning robot.

A "swimming pool cleaning robot" is an apparatus for cleaning an immersed surface, in other words typically an apparatus that moves within or at the bottom of a swimming pool, and is adapted to filter debris deposited on a surface. Such an apparatus is commonly called a swimming pool cleaning robot when it includes automated management means for displacements along the bottom and on the walls of the swimming pool to cover the entire surface to be cleaned.

In this description, we incorrectly use the term "liquid" to denote the mix of water and debris in suspension in the swimming pool or in the fluid circulation circuit within the cleaning apparatus.

Since the robot moves by friction on a surface, it is understandable that the drive and guidance means include means of creating contact pressurisation between the robot and the surface. These contact pressurisation means may for example by related to the pumping means that create a negative pressure between the robot and the surface along which the robot is moving. It should be emphasised that the drive, guidance and contact pressurisation means may be controlled independently.

According to the invention, the control means comprise a pressure sensor for determining the immersion depth of the cleaning robot in a swimming pool, starting from the measurement of the ambient pressure around the robot.

Thus, the robot has a means of knowing the pressure at which it is immersed. The pressure sensor can be fixed to the robot or connected to the robot by a hose. The pressure sensor may also be independently inside the robot body or outside the robot body.

It should be emphasised that in the case of a sensor comprising at least one electronic component, the electronic component can be protected from water by being housed inside a sealed box or coated with resin. It could also be a sealed sensor containing the electronics inside the sensor body.

A state of the robot can be defined from the recorded pressure at the robot. For example, the robot can be in one of the following states:

robot out of water;
robot at the water line;
robot close to the water line;
robot in shallow immersion;
robot in deep immersion.

The pressure sensor can also help to guide the robot keeping it at constant depth, for example to clean the water line of the pool.

In preferred embodiments of the invention, the control means also include means of automatically controlling the pressure recorded by the pressure sensor to a set value.

The automatic pressure control means compare the measured value of the pressure with a value usually called the set value that is established manually or preferably automatically by the control means. In particular, the set value can indicate an immersion depth to which the cleaning robot must move for a predetermined duration. Starting from the difference between the measured value and the set value, the automatic control means modify at least one of the parameters of the drive and guidance means so as to guide the robot to the required immersion depth.

For example, the automatic control means can be made using a PID (acronym for Proportional-Integral-Derivative) regulation system.

Other automatic control means such as a P (Proportional) or PI (Proportional-Integral) regulation system can be used because the required precision and the pressure variation rates are low.

In some particular embodiments of the invention, the pressure sensor is an absolute pressure sensor.

In some particular embodiments of the invention, the pressure sensor is a relative pressure sensor measuring the pressure difference relative to a pressure in a sealed chamber used as a reference.

The sealed chamber may be a box inside which the pressure is equal to atmospheric pressure, one bar, or a vacuum. The sealed chamber may also be the robot motor block, the motor block being a sealed chamber inside which one of the cleaning robot motors is housed.

In some particular embodiments of the invention, the pressure sensor is a piezoelectric sensor.

Thus, the pressure sensor outputs an electric signal that depends on the pressure applied on a piezoelectric material.

In some particular embodiments of the invention, the pressure sensor is a piezoresistive sensor.

In some particular embodiments of the invention, the pressure sensor is a strain gauge fitted on a wall to which ambient pressure is applied.

In some particular embodiments of the invention, the control means include means of recording the time spent at at least one determined immersion depth of said cleaning robot.

Thus, when the pool comprises several levels to be cleaned, the robot can be guided towards a level at which the robot has spent less time cleaning.

In some particular embodiments of the invention, the control means are connected to an inclinometer fixed to the body of the robot.

Thus, the control means evaluate information provided by the pressure sensor and the inclinometer, and make a more precise adjustment of the operating parameters of the cleaning robot drive and guidance means. It should be emphasised that the inclinometer can be an accelerometer.

In some particular embodiments of the invention, the pressure sensor is located in a median plane of the robot body, said plane being perpendicular to the usual displacement axis.

Thus, if the pressure sensor is located at the middle of the cleaning robot between the front face and the back face of the robot, the water line or proximity to the water line can be detected automatically, regardless of whether the robot is moving forwards or backwards.

In some particular embodiments of the invention, the pressure sensor is at least partly housed inside the rigid sealed box containing a flexible membrane, the pressure sensor measuring the pressure inside said sealed box.

The sealed box may be a box fixed to the body of the cleaning robot or it may be the sealed block containing the robot motors. The pressure sensor measures a pressure proportional to the ambient pressure at the robot. In the case in which the pressure sensor is associated with an electronic board, said electronic board may advantageously be housed inside the sealed box. It should be emphasised that the sensor body can pass through a wall of said sealed box, in a sealed manner.

In some particular embodiments, the pressure sensor is at least partly housed inside a rigid sealed box through which a capillary tube passes with one end inside the box, said pressure sensor being connected to said end of the capillary tube in a sealed manner, and measuring the pressure at said end of the capillary tube, the sealed box being fixed to the body of the robot.

Thus, an electronic board associated with the pressure sensor can also be placed inside the sealed box.

In some particular embodiments, the sealed box is made from a plastic material with low thermal conductivity.

Thus, the temperature inside the box remains approximately constant, equal to the temperature of the water in the pool.

In some particular embodiments, the sealed box comprises a Faraday cage.

Thus, electronic components located inside the box are not affected by the magnetic field induced by the coils of an electric motor contained within the contact pressurisation means and the drive and guidance means of the robot.

The invention also relates to a control method for a pool cleaning robot, said robot comprising:

- pumping means for maintaining the flow of liquid in said hydraulic circuit,
- means of driving and guiding said robot on a surface,
- means of controlling operating parameters for the cleaning robot drive and guidance means, the control means comprising a pressure sensor for determining the immersion depth of the cleaning robot in a swimming pool, starting from the measurement of the ambient pressure around the robot.

Such a method includes a step in which the ambient pressure at the robot is compared with a value called the set pressure and a step to control the operating parameters of the drive and guidance means so as to reduce the difference between the ambient pressure and the set pressure.

In some particular embodiments, the method includes a step to adjust operating parameters of the drive and guidance means as a function of the pressure recorded by the pressure sensor.

In some particular embodiments of the invention, the method includes a step in which the control means guide the cleaning robot at a constant immersion depth, by automatically controlling the pressure recorded by the pressure sensor to a set value.

In some particular embodiments of the invention, the method includes a step in which the control means are calibrated during the first climb along a wall of the pool to be cleaned, by adjusting the operating parameters of the drive and guidance means so as to reliably bring the robot to the water line.

In some particular embodiments of the invention, the method includes a step in which the control means determine the atmospheric pressure as being equal to the minimum pressure recorded during the first climb.

In some particular embodiments of the invention, the method includes a step in which the control means record the atmospheric pressure before the robot is immersed in the pool.

In some particular embodiments of the invention, the method includes the following steps:

- the control means detect that the cleaning robot is climbing along a wall;
- as soon as climbing is detected, the control means adjust the operating parameters of the drive and guidance means of the cleaning robot, so as to allow climbing along the wall;
- the control means detect the approach to the water line at a distance D from the water line, when the pressure recorded by the pressure sensor is equal to the sum of the atmospheric pressure and the pressure of water with head D;
- as soon as the approach to the water line is detected, the control means adjust the operating parameters of the drive and guidance means of the cleaning robot, by progressively reducing the power of the drive and guidance means, so that the cleaning robot reaches the water line with a low vertical velocity, approximately equal to zero.

In some particular embodiments of the invention, the method includes a step in which the cleaning robot follows the water line by being guided by a set pressure equal to approximately atmospheric pressure.

In some particular embodiments of the invention, the method includes a step in which the control means modify the atmospheric set pressure if the cleaning robot draws in air when the robot is cleaning the water line.

In some particular embodiments of the invention, the method includes a step in which, after it has been detected that the cleaning robot is having difficulty in reaching the water line, or is even incapable of reaching it despite the adjustment to operating parameters of the drive and guidance and/or the guidance means, information is displayed on a user interface to notify that the filter must be cleaned.

In some particular embodiments of the invention, the method includes a step to record the cleaning time spent by the cleaning robot within at least one given depth range.

For example, a depth range corresponds to depth values within the interval centred around a given depth value.

In some particular embodiments of the invention, the method includes a step in which the control means include at least one set cleaning time to be spent in cleaning a given depth range.

In some particular embodiments of the invention, the method includes a step in which the control means include at least one relative cleaning set value comparing times spent between at least two given depth ranges.

The invention also relates to an immersed surface cleaning apparatus characterised by all or some of the characteristics mentioned above or below, in combination.

PRESENTATION OF THE FIGURES

The characteristics and advantages of the invention will be better appreciated after reading the following description that presents characteristics of the invention through a non-limitative example application.

Figure 2:
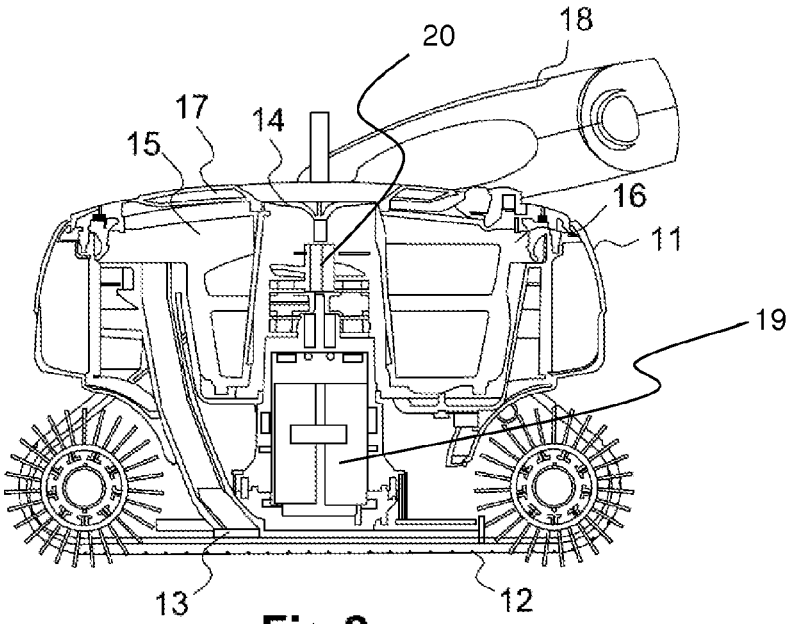
Figure 3A:
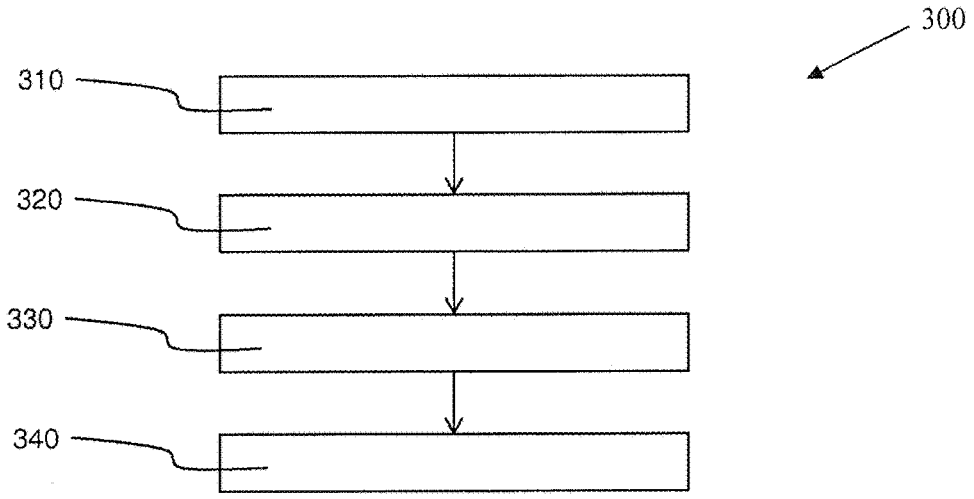
Figure 3B:
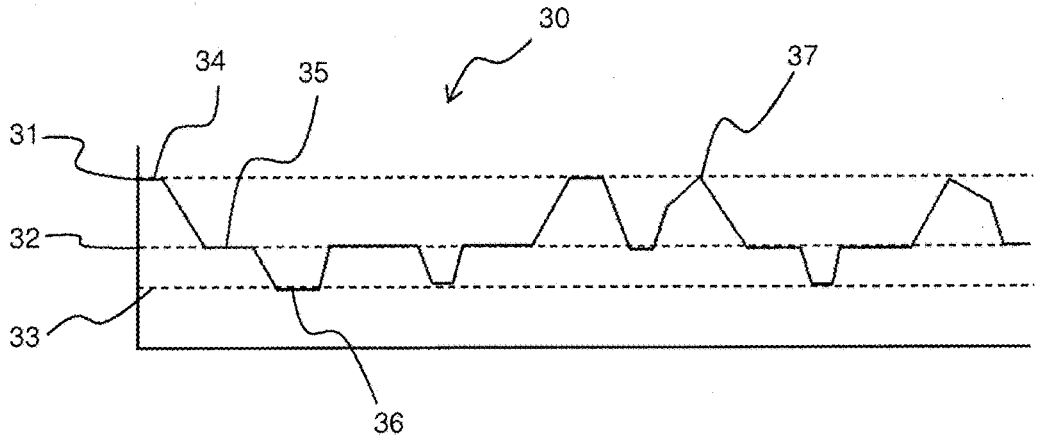
Figure 4A:
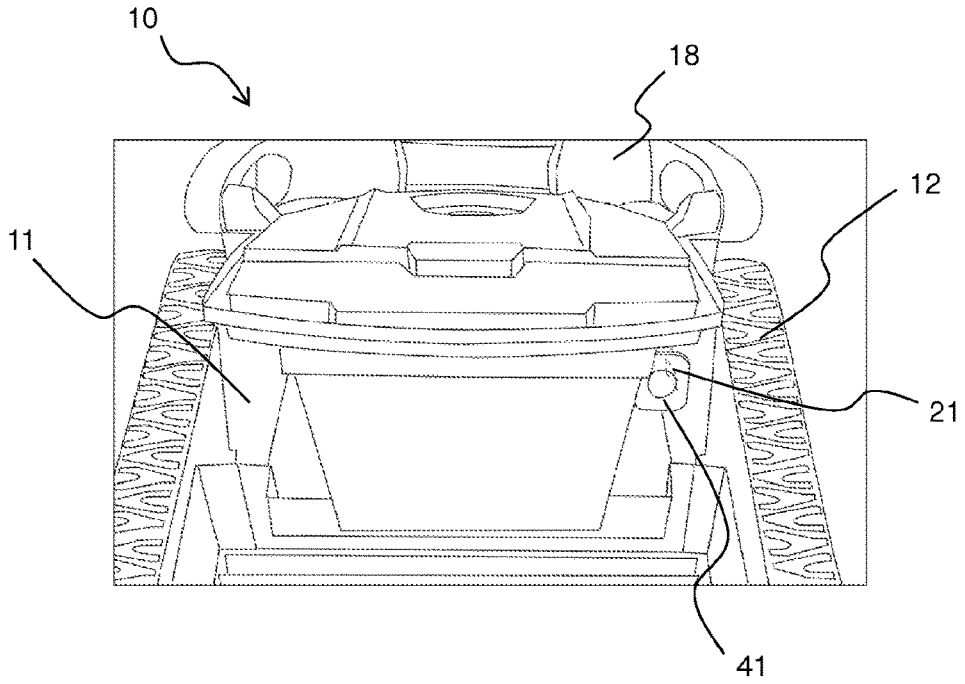
Figure 4B:
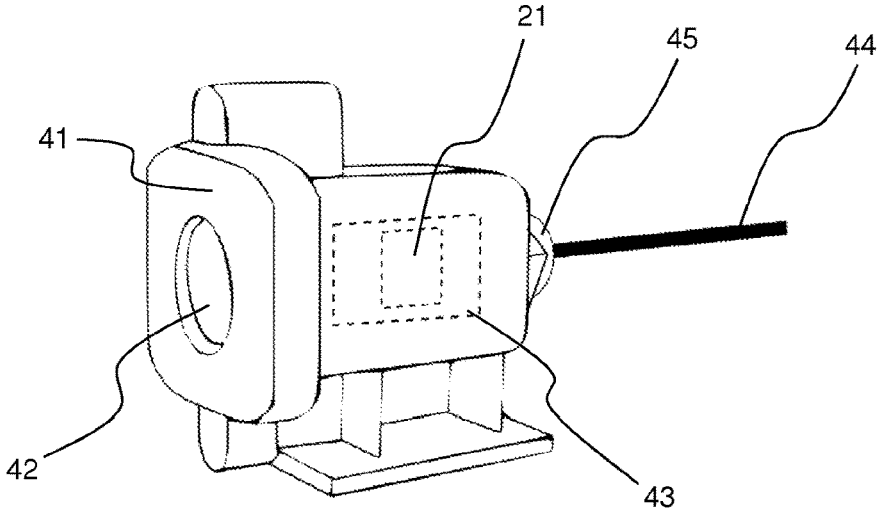

The description is based on the appended figures among which:

FIG. 1 illustrates a perspective view of a swimming pool cleaning robot using a filtration system as presented, FIG. 2 illustrates a sectional view of the same apparatus in a longitudinal vertical plane, FIG. 3*a* illustrates a method of controlling the same apparatus in the form of a block diagram, FIG. 3*b* illustrates a recorded curve of the pressure measured by the pressure sensor of the same apparatus as a function of time, FIG. 4*a* illustrates a front view of a variant embodiment of the same apparatus, FIG. 4*b* illustrates a perspective view of a sealed box containing the pressure sensor of this variant embodiment of the same apparatus.

DETAILED DESCRIPTION OF ONE EMBODIMENT OF THE INVENTION

The invention is used in a technical swimming pool environment, for example an in-ground family-type swimming pool.

In this non-limitative example embodiment, an immersed surface cleaning apparatus comprises a cleaning unit called a swimming pool cleaning robot in the following, a power supply unit and a control unit for said swimming pool cleaning robot.

The cleaning unit is represented in one embodiment given herein as an example, in FIGS. 1 and 2.

The swimming pool cleaning unit 10 comprises a body 11 and a drive and guidance device comprising elements 12 that drive and guide the body on an immersed surface. In this non-limitative example, these drive and guidance elements are composed of wheels or tracks arranged at the side of the body (see FIG. 1).

The swimming pool cleaning robot 10 also includes a motor driving said drive and guidance elements, said motor being powered in this example embodiment through a board located inside the robot.

For the remainder of this description, a relative coordinate system $X_rY_rZ_r$ for this cleaning robot 10 is defined, in which:

- a longitudinal axis $X_r$ is defined as the displacement axis of the cleaning robot 10 when the displacement wheels 12 are controlled to move identically,
- a transverse axis $Y_r$ is defined as being perpendicular to the longitudinal axis $X_r$, and located in a plane parallel to the bearing plane of the displacement wheels 12 of the cleaning robot 10, this lateral axis $Y_r$ thus being parallel to the rotation axis of the wheels,
- a vertical axis $Z_r$ is defined as being perpendicular to the other two axes, the bottom of the robot along this vertical axis $Z_r$ being located between said robot and the wall followed and the top of the robot along this axis being the part of the robot furthest from the surface followed.

The concepts of front, back, left, right, high, low, upper, lower, etc. are defined relative to this coordinate system $X_rY_rZ_r$.

The drive and guidance elements define a guidance plane on an immersed surface by their contact points with said immersed surface. Said guidance plane, parallel to the plane formed by the longitudinal and transverse axes, is usually approximately tangent to the immersed surface at the location at which the apparatus is located. For example, said guidance plane is approximately horizontal when the apparatus moves on an immersed surface at the bottom of the pool.

Throughout this disclosure, a "low" element is closer to the guidance plane than a high element.

The pool cleaning robot 10 comprises a hydraulic circuit comprising at least one liquid inlet 13 and one liquid outlet 14. In this non-limitative example, the liquid inlet 13 is located at the bottom of the body 11 (in other words under the body when the swimming pool cleaning robot is placed in its normal working position at the bottom of the pool), in other words immediately facing an immersed surface along which the swimming pool cleaning robot 10 is moving, so as to draw in accumulated debris on said immersed surface. The liquid outlet 14 is located on top of the swimming pool cleaning robot 10.

In this example embodiment, the liquid outlet 14 is in a direction approximately perpendicular to the guidance plane, in other words vertically if the swimming pool cleaning robot 10 is on the bottom of the swimming pool, and horizontally if the cleaning apparatus is currently moving along a vertical wall of the swimming pool.

The hydraulic circuit connects the liquid inlet 13 to the liquid outlet 14. The hydraulic circuit is adapted to maintain liquid circulation from the liquid inlet 13 to the liquid outlet 14. To achieve this, the swimming pool cleaning robot 10 comprises a pump comprising a motor 19 and an impeller 20 located in the hydraulic circuit. The motor 19 drives the impeller 20 in rotation.

This pump provokes firstly water intake at the level of the water inlet 13 located under the cleaning robot 10, therefore immediately adjacent to the surface along which the cleaning robot 10 is travelling, and secondly water discharge through the water outlet 14 that is approximately perpendicular to the bearing plane of the cleaning robot 10 and therefore to the surface along which it is travelling. These two phenomena, suction under the robot 10 and discharge of water under pressure above the robot 10, govern the contact pressurisation forces applied on the cleaning robot 10 towards the surface along which the robot 10 is travelling. Adhesion of the cleaning robot 10 to the wall is thus improved, which facilitates climbing of the cleaning robot 10.

The apparatus comprises a filtration chamber 15 interposed between the liquid inlet 13 and the liquid outlet 14 on the hydraulic circuit.

The filtration chamber 15 that separates and stores debris in suspension in the liquid, comprises a filtration basket 16 and a lid 17 forming the upper surface of the filtration chamber 15.

The filtration basket 16 can be extracted, in other words it can be extracted from and inserted into the body 11 of the cleaning robot 10. The body 11 of the cleaning robot 10 has a housing for this purpose inside which the filtration basket 16 can be installed. The fact that the filtration basket 16 can be extracted makes it easy to empty it, particularly without needing to manipulate the entire robot 10.

In this example, the swimming pool cleaning robot 10 is supplied with energy through a sealed flexible cable. In this example, this flexible cable is attached to the top part of the body of the swimming pool cleaning robot 10. The other end of this flexible cable is connected to the power supply unit (not shown on FIG. 1) located outside the pool, this power supply unit itself being connected to the mains electricity power supply.

In this case, the swimming pool cleaning robot 10 also comprises a gripping handle 18 adapted to enable a user to take the robot out of the water, particularly when the filter has to be cleaned.

Operating parameters of the cleaning robot 10, for example such as the type of cleaning cycle requested by the user, are adjusted by means of a user interface located on the power supply unit.

Note that such a cleaning robot frequently includes two cleaning cycles. In a first cycle, the robot travels along the bottom of the swimming pool and cleans it without climbing the side walls. In a second cycle, the robot travels along the bottom of the swimming pool and also climbs the side walls, to detach debris stuck to the walls or that concentrate at the water line. In this second cycle, the robot climbs along the side wall, emerges partially to scrub the water line with its brush, tilts to move laterally along the wall and then goes down again by reversing the direction of running to go back to the bottom while cleaning the wall once again.

During the different cycles, the control unit (not shown on FIG. 1) of the robot 10, housed in a sealed casing close to the motors, adjusts the operating parameters of the displacement elements drive motor and the fluid circulation pump, thus acting on the contact pressurisation forces applied on the robot towards the surface along which it is travelling.

In this example embodiment, the cleaning robot 10 comprises a pressure sensor 21 fixed to the body 11 of the cleaning robot 10.

In one variant of this particular embodiment of the invention, the pressure sensor is connected to the robot through a hose. The hose may be fixed to the body of the robot.

The control unit of the robot 10 uses the piezoresistive type pressure sensor 21 to determine the immersion depth in the pool starting from the measurement of the absolute pressure at which the cleaning robot 10 is immersed.

The control unit of the robot 10 comprises means of automatically controlling the pressure so as to guide the robot 10 at a pressure corresponding to a set value, subsequently called the set pressure. In this non-limitative example of the invention, the automatic pressure control means are made using a PID regulator. The set pressure varies with time so as to guide cleaning of the robot 10 within the swimming pool.

The set pressure may also be constant over a time range so as to guide the robot 10 at a given depth.

In variants of this particular embodiment of the invention, the pressure sensor may be a piezoelectric sensor, for example comprising a strain gauge. It may also be any other type of measurement sensor indicating the depth at which the cleaning robot is positioned, for example such as a float in a capillary tube.

In this example, the pressure sensor 21 comprises a sealed body inside which the sensor electronics is located.

In one variant of this particular embodiment of the invention, the sensor electronics can be protected by resin or can be contained inside a sealed box.

It should be emphasised that the pressure sensor 21 is advantageously housed outside the hydraulic fluid circulation circuit because the pumps create a pressure inside the hydraulic circuit lower than the local pressure. Furthermore, the value of this negative pressure depends on the instantaneous power of the pumps, and varies with time.

Since the mass of the robot tends to increase with the collection of debris while the pool is being cleaned, the control unit adjusts the power of the drive and/or pumping motors so as to increase the capacity of the robot to reach the water line.

Furthermore, the control unit deduces the climb or descent rate from pressure variations recorded by the pressure sensor 21. The control unit then automatically adjusts the velocity of the drive devices, as a function of robot adhesion conditions on the wall.

Moreover, the control unit can detect using of the pressure sensor 21 when the robot is close to water line during climbing phases along a wall of the pool.

The pressure sensor 21 is advantageously fixed to the middle of cleaning robot 10 along the usual direction of displacement of the robot 10, close to one of the displacement and guidance elements 12. This median position of the pressure sensor 21 thus enables the control unit to detect the water line when the recorded pressure us equal to atmospheric pressure plus the pressure corresponding to half the length of the cleaning robot 10. It should be emphasised that this detection of the water line is made both along the normal and reverse directions of the cleaning robot 10.

In one variant of this particular embodiment of the invention, the pressure sensor 21 is housed in the centre of the front face of the robot, thus enabling the control device of the drive and guidance means to detect the water line when the recorded pressure is significantly higher than atmospheric pressure. In variants of this embodiment of the invention, the pressure sensor 21 may be located at any other location of the robot, preferably but non-limitatively in the robot.

It should be emphasised that the control unit of the robot 10 is calibrated during its first climb along the wall of a pool to be cleaned, to assure that the water line can be detected reliably. To achieve this, the control unit adjusts the operating parameters of the drive and contact pressurisation motors so as to reliably bring the robot 10 to the water line. The control unit determines the atmospheric pressure as being the minimum pressure recorded during this first climb. The control unit also confirms that atmospheric pressure is approximately unchanged each time that the cleaning robot reaches the water line.

In one variant of this embodiment, the control unit records the atmospheric pressure before the robot is immersed into the pool.

Use of the pressure sensor 21 also enables the control unit to modify the motor parameters while the cleaning robot 21 is climbing the wall of a swimming pool.

To achieve this, the control unit of the cleaning robot 21 follows the control method 300 illustrated on FIG. 3*a* in the form of a block diagram.

During the first step 310, the control means detect that the cleaning robot is climbing along a wall. The climb results in a continuous reduction in the pressure recorded by the pressure sensor 21. It should be emphasised that the pressure measurement can be smoothed so as to ignore very small variations induced by sensor noise.

As soon as climbing is detected, the control unit adjusts the operating parameters of the drive and contact pressurisation motors of the cleaning robot 10, during step 320, so as to allow climbing along the wall.

In step 330, the control unit detects the approach to the water line. For example, this detection takes place at a distance of the order of fifty centimeters from the water line. This distance is detected when the pressure recorded by the pressure sensor 21 is equal to the sum of the atmospheric pressure $P_{at}$m and the pressure of the water head $P_{CE}$ equal to fifty centimeters. In this case, $P_{CE}$ is equal to fifty millibars or fifty hectoPascals.

As soon as the approach to the water line is detected, the control unit then progressively reduces the operating power of the drive and contact pressurisation means during step 340, so that the cleaning robot 10 reaches the water line with a low vertical velocity, approximately equal to zero.

The robot 10 can then follow the water line by being guided to maintain a pressure approximately equal to atmospheric pressure. To achieve this, the value of the set pressure may be equal to atmospheric pressure or a value slightly greater than atmospheric pressure so that the robot 10 can follow the water line while always remaining immersed.

Note that use of the pressure sensor 21 also enables the control unit to modify the atmospheric set pressure if the cleaning robot 10 draws in air when the robot is cleaning the water line.

Nevertheless, if the mass of the cleaning robot 10 is increased as a result of collecting a large quantity of debris, the robot will not easily reach the water line and will sometimes be incapable of reaching it, despite the adjustment of operating parameters of the motors. A notification is then displayed on the user interface to inform the user that the filter has to be cleaned.

The set pressure that the robot uses to reach the water line is recorded.

Furthermore, the robot 10 can also advantageously be guided at a constant immersion depth by automatically controlling the pressure recorded by the pressure sensor 21 to a set value higher than atmospheric pressure. The robot 10 can thus for example clean the water line of the pool or it can clean along any depth in the pool.

Automatically control of the pressure generally consists firstly of comparing the ambient pressure of the robot with the current set pressure. Operating parameters of the drive and guidance means are then adjusted to reduce the difference between the ambient pressure and the set pressure.

In this embodiment non-limitatively described herein, the control unit also records the time spent at each depth. In general, the recording is made for depth ranges. In this non-limitative example of the invention, a depth range is a depth interval centred around a value of the set pressure.

The control unit can thus adapt the time spent by the robot in cleaning a specific depth, for example to clean the pool water line.

The curve 30 shown in FIG. 3*b* illustrates an example recording of the ambient pressure at the robot immersed in a swimming pool, as a function of time. In this example, the pool is divided into two zones: a shallow zone and a deeper zone corresponding to a diving pit. All three pressure levels can be seen on the curve 30. The highest pressure 31 corresponds to the bottom of the diving pit. The pressure 32 corresponding to the intermediate plateau corresponds to the depth of the shallow zone. The lowest pressure 33, approximately equal to atmospheric pressure, occurs when cleaning the water line of the pool.

In this case the robot 10 begins by cleaning the bottom of the diving pit, corresponding to a pressure 31 plateau 34. The robot then climbs into the shallow zone and cleans the bottom of this zone. The curve 30 thus includes a plateau 35 at intermediate pressure 32. The robot then climbs along a wall of the pool to clean the water line. A new plateau 36 corresponding to the lowest pressure represents cleaning of the water line. The robot then goes down again into the shallow zone. The robot thus cleans the different zones of the pool.

At each pressure level, the control unit of the cleaning robot 10 records times spent in cleaning the bottom of each zone of the pool. For example, when the robot enters the deepest zone, the control unit compares the time spent in this zone with the time spent in the shallow zone. If the time spent in the diving pit is longer than a previously determined threshold, the robot 10 reverses its direction of displacement and returns to the shallow zone to continue cleaning this zone. This inversion of the direction of displacement is illustrated on curve 30 by the peak 37.

It should be emphasised that a threshold duration is determined in each cleaning zone. This threshold can also be determined as an absolute value or a value relative to a duration in another zone to be cleaned. These threshold durations are chosen so as to homogenise cleaning of the swimming pool. These threshold durations can depend on the area of the surfaces to be cleaned.

Recording the duration spent at each depth also helps to achieve homogeneous cleaning of steps and inclined entry areas into a swimming pool.

In variants of this particular embodiment of the invention, the pressure sensor 21 advantageously measures the pressure inside a sealed rigid box. FIGS. 4*a* and 4*b* illustrate an example embodiment of one of these variants. The sealed box 41 comprising a pressure sensor 21 is fixed onto a side of the body 11 of the cleaning robot 10, as illustrated on FIG. 4*a*. The sealed box 41, illustrated in more detail in FIG. 4*b*, is made of plastic and comprises a flexible membrane 42. In this variant, the pressure sensor 21 is fixed onto an electronic board 43 fixed to the inside of the sealed box 41. The electronic board 43 is connected to the control unit of the robot 10 by a cable 44 passing through the sealed box 41 through a cable gland 45. The sealed cable 44 transmits a signal proportional the ambient pressure at the location at which the cleaning robot 10 is moving. The flexible membrane 42 in this example is made of flexible PVC. Its thickness is significantly less than one millimeter. The membrane can also be made of flexible polyurethane or a coated fabric.

It should be emphasised that the box 41 can also be used to thermally insulate the pressure sensor 21 from motors and other energy dissipaters. The pressure sensor 21 this remains at an approximately constant temperature equal to the temperature of the water. Measurements obtained by the pressure sensor 21 are then reliable and reproducible. The sealed box 41 can also magnetically insulate magneto-sensitive components such as compasses or electronic components contained in the box 41. To achieve this, the sealed box 41 may include a Faraday cage.

In variant embodiments of the invention, the pressure sensor is partly housed inside a rigid sealed box fixed to the body of the robot. A capillary tube passes through the sealed box, with one end being connected in waterproof manner to the pressure sensor.

In some variant embodiments of the invention, the pressure sensor is a relative pressure sensor measuring the pressure relative to a pressure in a sealed chamber used as a reference. The sealed chamber may be a box inside which the pressure is equal to atmospheric pressure, one bar, or a vacuum. The sealed chamber may also be the robot motor block, the motor block being a sealed chamber inside which the drive motor of the cleaning robot displacement elements is housed. Nevertheless, it should be emphasised that the temperature of the motor block varies with time. Therefore this reference pressure has to be modified to take account of pressure variations related to temperature variations in a constant volume.

In some variant embodiments of the invention, the cleaning robot 10 also comprises means of determining the attitude of the robot in the swimming pool at all times. To achieve this, the cleaning robot 10 may for example comprise at least one inclinometer of a type known in itself, or a means of detecting the changeover to being vertical, of the "tilt" type or another other equivalent device known to an expert in the subject. This inclinometer, that can be an accelerometer, can be used to determine the orientation of the cleaning robot along three axes. The control unit can then process information from means of determining the orientation of the robot 10 in the swimming pool, by associating them with the immersion depth measured by the pressure sensor 21. Thus, the control unit can more precisely and more accurately adjust the operating parameters of the drive and contact pressurisation motors of the cleaning robot 10.

The characteristics described above are not limitative and many other characteristics related to the use of an ambient pressure sensor can be achieved.

The invention claimed is:

1. Swimming pool cleaning robot comprising:

a body, at least one hydraulic liquid circulation circuit between at least one liquid inlet and at least one liquid outlet, said hydraulic circuit comprising at least one means of separating debris in suspension in a liquid, pumping means for maintaining a flow of liquid in said hydraulic circuit, means of driving and guiding said cleaning robot on a surface, means of controlling operating parameters of the means of driving and guiding said cleaning robot, wherein the control means comprise a pressure sensor for determining an immersion depth of the cleaning robot in a swimming pool, starting from a measurement of ambient pressure around the cleaning robot, and means of automatically controlling a pressure recorded by the pressure sensor to a set value.

2. Cleaning robot according to claim 1, wherein the pressure sensor is an absolute pressure sensor.

3. Cleaning robot according to claim 1, wherein the pressure sensor is a relative pressure sensor measuring a pressure difference relative to a pressure in a sealed chamber used as a reference.

4. Cleaning robot according to claim 1, wherein the pressure sensor is a piezoelectric sensor.

5. Cleaning robot according to claim 4, wherein the pressure sensor is a piezoresistive sensor.

6. Cleaning robot according to claim 4, wherein the pressure sensor is a strain gauge fixed on a wall to which ambient pressure is applied.

7. Cleaning robot according to claim 1, wherein the control means include means of recording a time spent in at least one determined immersion depth range of said cleaning robot.

8. Cleaning robot according to claim 1, wherein the control means are connected to at least one inclinometer fixed to the body of the cleaning robot.

9. Cleaning robot according to claim 1, wherein the pressure sensor is located in a median plane of the body, said plane being perpendicular to a usual displacement axis.

10. Cleaning robot according to claim 1, wherein the pressure sensor is at least partly housed inside a rigid sealed box containing a flexible membrane, the pressure sensor measuring the pressure inside said rigid sealed box.

11. Cleaning robot according to claim 10, wherein the rigid sealed box is made from a plastic material.

12. Cleaning robot according to claim 10, wherein the rigid sealed box contains a Faraday cage.

13. Cleaning robot according to claim 1, wherein the pressure sensor is at least partly housed inside a rigid sealed box through which a capillary tube passes with one end inside the rigid sealed box, said pressure sensor being connected to said end of the capillary tube in a sealed manner, and measuring the pressure at said end of the capillary tube.

14. Method of controlling a pool cleaning robot, said cleaning robot comprising:

pumping means for maintaining a flow of liquid in a hydraulic circuit, means of driving and guiding said cleaning robot on a surface, means of controlling operating parameters for the drive and guidance means of said cleaning robot, the control means comprising a pressure sensor that can be used to determine an immersion depth of the cleaning robot in a swimming pool, starting from a measurement of ambient pressure around the cleaning robot, wherein the method includes a step in which the ambient pressure is compared with a value called a set pressure and a step to control the operating parameters of the drive and guidance means so as to reduce a difference between the ambient pressure and the set pressure.

15. Method according to claim 14, wherein the method includes a step in which the control means are calibrated during a first climb along a wall of a pool to be cleaned, by adjusting the operating parameters of the drive and guidance means so as to reliably bring the cleaning robot to a water line.

16. Method according to claim 15, wherein the method includes a step in which the control means determine atmospheric pressure as being equal to a minimum pressure recorded during the first climb.

17. Method according to claim 16, wherein the method comprises the following steps:

the control means detect that the cleaning robot is climbing along a wall;

as soon as climbing is detected, the control means adjust the operating parameters of the drive and guidance means of the cleaning robot, so as to allow climbing along the wall;

the control means detect the approach to a water line at a distance D from the water line, when the pressure recorded by the pressure sensor is equal to the sum of the atmospheric pressure and a pressure of water at the distance D from the water line;

as soon as the approach to the water line is detected, the control means adjust the operating parameters of the drive and guidance means of the cleaning robot, by progressively reducing the power of the drive and guidance means, so that the cleaning robot reaches the water line with a low vertical velocity, approximately equal to zero.

18. Method according to claim 17, wherein the method includes a step in which the cleaning robot follows the water line by being guided by a set pressure equal to approximately atmospheric pressure.

19. Method according to claim 18, wherein the method includes a step in which the control means modify the set pressure if the cleaning robot draws in air when the cleaning robot is cleaning the water line.

20. Method according to claim 17, wherein the method includes a step in which the control means modify operating parameters for the drive and guidance means of the cleaning robot to reduce the approach velocity towards the water line, if the cleaning robot draws in air when the cleaning robot is cleaning the water line.

21. Method according to claim 14, wherein the method includes a step in which the control means record atmospheric pressure before the cleaning robot is immersed in a pool.

22. Method according to claim 17, wherein the method includes a step in which, after it has been detected that the cleaning robot is having difficulty in reaching a water line, or is even incapable of reaching the water line despite the adjustment to operating parameters of the drive and guidance means, information is displayed on a user interface to notify that a filter of the cleaning robot must be cleaned.

23. Method according to claim 14, wherein the method includes a step to record the cleaning time spent by the cleaning robot at at least one given depth range.

24. Method according to claim 23, wherein the method includes a step in which the control means include at least one set cleaning time to be spent in cleaning a given depth range.

25. Method according to claim 23, wherein the method includes a step in which the control means include at least one relative cleaning set value comparing times spent between at least two given depth ranges.

* * * * *